US009649681B1

(12) United States Patent
Sievers et al.

(10) Patent No.: US 9,649,681 B1
(45) Date of Patent: May 16, 2017

(54) CERAMIC DIE INCLUDING A PLURALITY OF PREFERENTIALLY LOCATED FIBERS AND ASSOCIATED METHOD OF CONSTRUCTING A CERAMIC DIE

(71) Applicant: The Boeing Company, Chicago, IL (US)

(72) Inventors: Daniel E. Sievers, Owens Cross Roads, AL (US); David P. Heck, Saint Charles, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/185,752

(22) Filed: Jun. 17, 2016

(51) Int. Cl.

| | |
|---|---|
| ***B21D 37/01*** | (2006.01) |
| ***B28B 1/00*** | (2006.01) |
| ***B21D 37/10*** | (2006.01) |
| ***B21D 37/20*** | (2006.01) |
| ***B21C 25/02*** | (2006.01) |
| ***B21D 26/033*** | (2011.01) |

(52) U.S. Cl.
CPC ..... *B21D 37/01* (2013.01); *B21C 25/025* (2013.01); *B21D 26/033* (2013.01); *B21D 37/10* (2013.01); *B21D 37/20* (2013.01); *B28B 1/008* (2013.01)

(58) Field of Classification Search
CPC ..... B21D 26/033; B21D 37/20; B21D 37/01; B21D 37/10; B21C 25/025; B28B 1/008
USPC ..... 72/56; 76/107.1
See application file for complete search history.

(56) References Cited

U.S. PATENT DOCUMENTS

| | | | | |
|---|---|---|---|---|
| 3,125,974 | A * | 3/1964 | Toulmin, Jr. | B21D 37/20 249/134 |
| 4,769,346 | A * | 9/1988 | Gadkaree | B21C 25/025 264/DIG. 19 |
| 5,467,626 | A | 11/1995 | Sanders | |
| 5,638,724 | A | 6/1997 | Sanders | |
| 5,661,992 | A | 9/1997 | Sanders | |
| 6,235,381 | B1 | 5/2001 | Sanders et al. | |
| 7,024,897 | B2 * | 4/2006 | Pfaffmann | B21D 26/033 148/520 |

* cited by examiner

*Primary Examiner* — David B Jones
(74) *Attorney, Agent, or Firm* — Alston & Bird LLP

(57) ABSTRACT

A ceramic die for a hot press is provided, along with a method of constructing a ceramic die. The ceramic die includes a ceramic die body defining a mold surface configured to shape a part during a superplastic forming process. The mold surface defines at least one curved surface and at least one non-curved surface, spaced apart from the at least one curved surface. The ceramic die also includes a plurality of fibers disposed within the ceramic die body. The plurality of fibers may be preferentially located proximate the at least one curved surface such that a first portion of the ceramic die body proximate the at least one curved surface has a greater percentage of fibers than a second portion of the ceramic die body proximate the at least one non-curved surface.

19 Claims, 7 Drawing Sheets

CERAMIC DIE INCLUDING A PLURALITY OF PREFERENTIALLY LOCATED FIBERS AND ASSOCIATED METHOD OF CONSTRUCTING A CERAMIC DIE

TECHNOLOGICAL FIELD

An example embodiment relates generally to a ceramic die for a hot press and, more particularly, to a ceramic die including a plurality of preferentially located fibers and an associated method of constructing a ceramic die.

BACKGROUND

During the fabrication of various parts, such as aircraft parts or parts for other applications, a hot press, such as a hot forming press or a superplastic forming press, may be utilized to heat and form the parts. In order to shape the parts, a hot press may include a die defining a mold surface again which a workpiece, such as a sheet of titanium, is pressed. During superplastic forming operations, such as through the application of an elevated temperature and a pressure differential between opposite sides of the workpiece, the workpiece may be formed so as to have the shape defined by the mold surface. In order to form the part so as to have the desired shape, the die should advantageously maintain the integrity of the mold surface throughout one or more superplastic forming operations.

Some dies are formed of metal alloys that withstand the repeated high temperature superplastic forming cycles, such as by withstanding the repeated exposure to temperatures up to 1650° F. utilized in a superplastic forming process. While a die that is formed of these metal alloys has a relatively long life as measured in terms of the number of superplastic forming cycles, dies formed of these metal alloys are quite expensive. As an alternative to the expensive metal dies, ceramic dies are sometimes utilized in conjunction with superplastic forming operations. Ceramic dies are much more economical, but typically have a relatively short life. For example, ceramic dies generally withstand only 10 or fewer superplastic forming cycles and, in some instances, withstand no more than two superplastic forming cycles prior to failure, thereby requiring the ceramic dies to be repeatedly replaced.

In regards to the failure of a ceramic die, ceramic dies are formed of materials that are somewhat brittle and have a relatively low tensile strength. Although ceramic dies may be reinforced with fused quartz rods to add a compressive stress field in regions near the rods, the fused quartz rods can only be placed at certain locations and cannot be spaced throughout the entirety of the ceramic die such that their effect is somewhat limited. As such, ceramic dies may fail when subjected to the high temperature forming cycles and to the pressures exerted during superplastic forming operations. In this regard, ceramic dies may fail by the formation and propagation of cracks through the mold surface defined by the ceramic dies, such as near the interior corners of the mold surface. Further, as a result of the relatively low tensile strength of the ceramic material that forms the dies, any sticking of the ceramic material to the part being formed results in portions of the mold surface of the ceramic die flaking off, thereby damaging both the ceramic die and the part being formed.

In addition to the relatively short life of ceramic dies, the interruption that is created upon the failure of a die, such as a ceramic die, during a superplastic forming operation is also costly, both financially and in terms of down time. In this regard, the failure of a die, such as a ceramic die, during a superplastic forming operation will cause a significant delay in the superplastic forming process in order to cool the hot press, remove the ceramic die that has failed, insert another ceramic die within the hot press and then reheat the hot press. This process of replacing a ceramic die that has failed may delay the superplastic forming process by several hours and incur significant costs. In addition, the relatively short life of ceramic dies generally requires that one or more additional ceramic dies be maintained as spare parts so as to facilitate such repairs in the event of the failure of the ceramic die currently in use.

BRIEF SUMMARY

A ceramic die for a hot press is provided, along with a method of constructing a ceramic die. The ceramic die is selectively reinforced in a manner that reduces the likelihood of cracking and the likelihood of flaking of the mold surface. Thus, the ceramic die of an example embodiment has a longer lifetime in order to reduce the overall costs associated with superplastic forming operations. Additionally, a hot press employing the ceramic die needs to be taken off line less frequently in order to replace a ceramic die that has failed, thereby reducing the financial cost and down time associated with replacing a ceramic die that has failed during superplastic forming operations.

In an example embodiment, a ceramic die is provided that includes a ceramic die body defining a mold surface configured to shape a part during a superplastic forming process. The mold surface defines at least one curved surface and at least one non-curved surface, spaced apart from the at least one curved surface. The ceramic die also includes a plurality of fibers, such as ceramic fibers, disposed within the ceramic die body. In this embodiment, the plurality of fibers are preferentially located proximate the at least one curved surface such that a first portion of the ceramic die body proximate the at least one curved surface has a greater percentage of fibers than a second portion of the ceramic die body proximate the at least one non-curved surface.

The plurality of fibers of an example embodiment comprise a weave or tape of fibers located proximate the at least one curved surface. The ceramic die body of this embodiment that is proximate the at least one non-curved surface is independent of the weave or tape of fibers. The plurality of fibers of an example embodiment extend about the at least one curved surface and terminate prior to extending across the at least one non-curved surface. The plurality of fibers of an example embodiment are also preferentially located proximate the mold surface relative to a portion of the ceramic die body spaced apart from the mold surface.

In another example embodiment, a ceramic die is provided that includes a ceramic die body defining a mold surface configured to shape a part during a superplastic forming process. The ceramic die also includes a plurality of fibers, such as ceramic fibers, disposed within the ceramic die body. In this embodiment, the plurality of fibers are preferentially located proximate the mold surface such that a first portion of the ceramic die body proximate the mold surface has a greater percentage of fibers than a second portion of the ceramic die body spaced apart from the mold surface.

The plurality of fibers of an example embodiment comprise a weave or tape of fibers located proximate the mold surface. The second portion of the ceramic die body of this embodiment that is spaced apart from the surface is independent of the weave or tape of fibers. The mold surface of an example embodiment defines at least one curved surface and at least one non-curved surface, spaced apart from the at least one curved surface, with the plurality of fibers also being preferentially located proximate the at least one curved surface. The plurality of fibers of this example embodiment extend about the at least one curved surface and terminate prior to extending across the at least one non-curved surface.

In a further embodiment, a method of constructing a ceramic die is provided that includes applying a layer of ceramic material to define a mold surface of a ceramic die body. The method also includes applying a plurality of fibers, such as ceramic fibers, to at least portions of the layer of ceramic material and applying additional ceramic material over the plurality of fibers. The additional ceramic material forms a greater extent of the ceramic die body than the layer of ceramic material such that the fibers are preferentially located proximate the mold surface since that a first portion of the ceramic die body proximate the mold surface has a greater percentage of fibers than a second portion of the ceramic die body spaced apart from the mold surface.

The method of an example embodiment applies the plurality of fibers by applying a weave or tape of fibers to at least portions of the layer of ceramic material. In an example embodiment, the second portion of the ceramic die body spaced apart from the surface is independent of the weave or tape of fibers. The mold surface of an example embodiment defines at least one curved surface and at least one non-curved surface, spaced apart from the at least one curved surface. In this example embodiment, the method applies the plurality of fibers by applying the plurality of fibers so as to also be preferentially located proximate the at least one curved surface. For example, the method applies the plurality of fibers by extending the plurality of fibers about the at least one curved surface so as to terminate prior to extending across the at least one non-curved surface. The method of an example embodiment applies the plurality of fibers by applying the plurality of fibers such that the ceramic die body proximate the at least one non-curved surface is independent of the weave or tape of fibers.

BRIEF DESCRIPTION OF THE DRAWINGS

Figure 1:
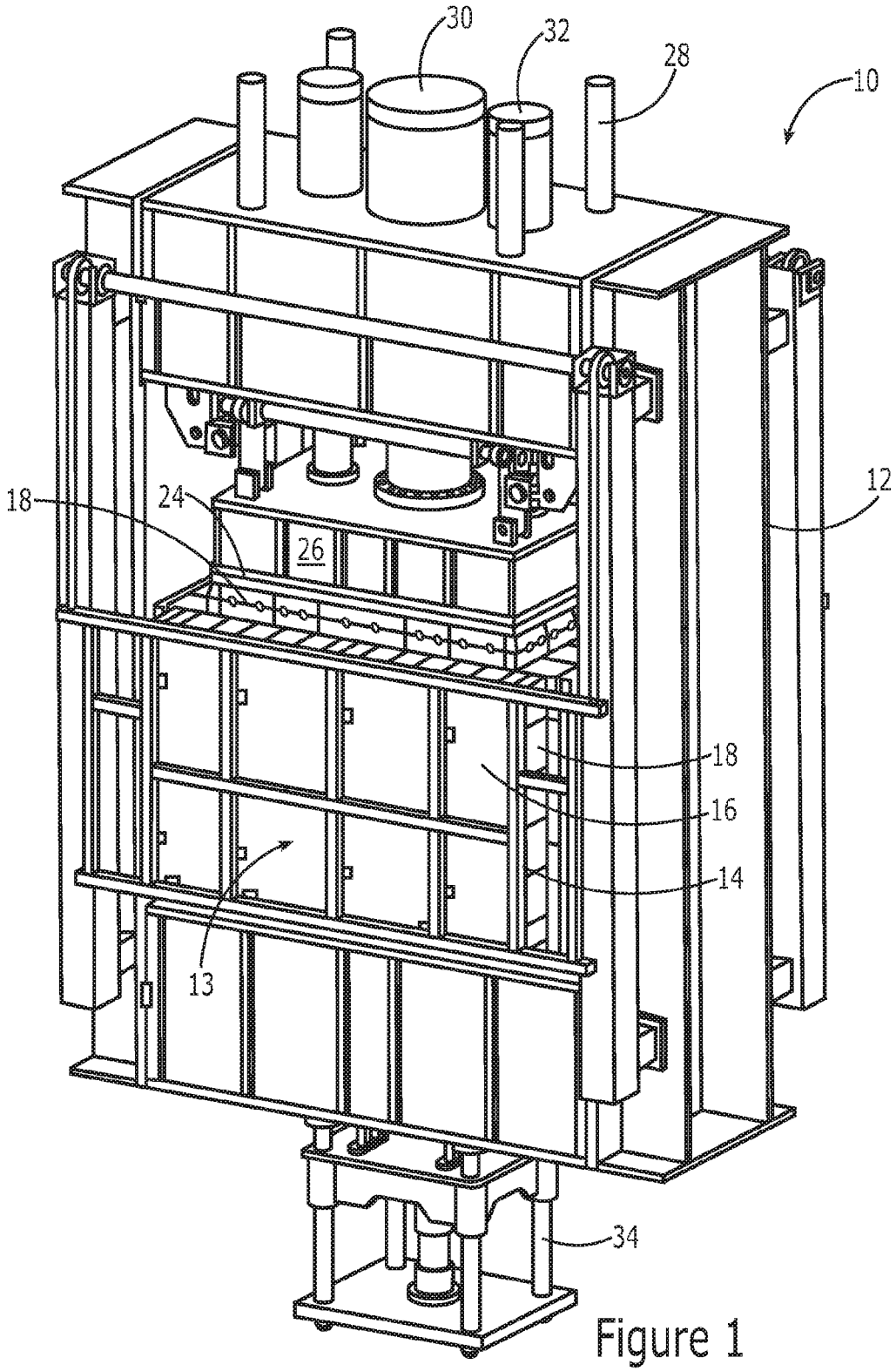
Figure 2:
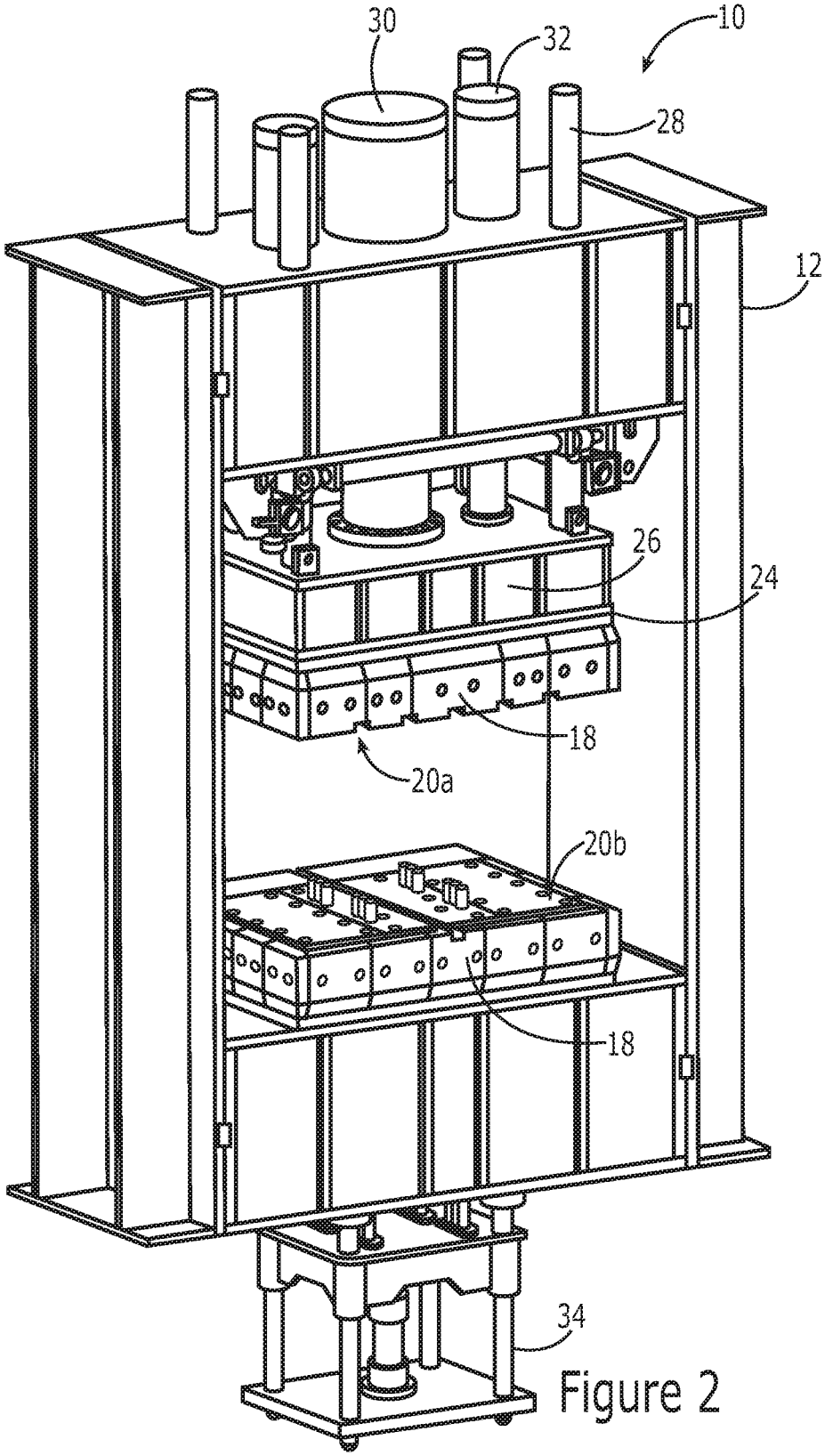
Figure 3:
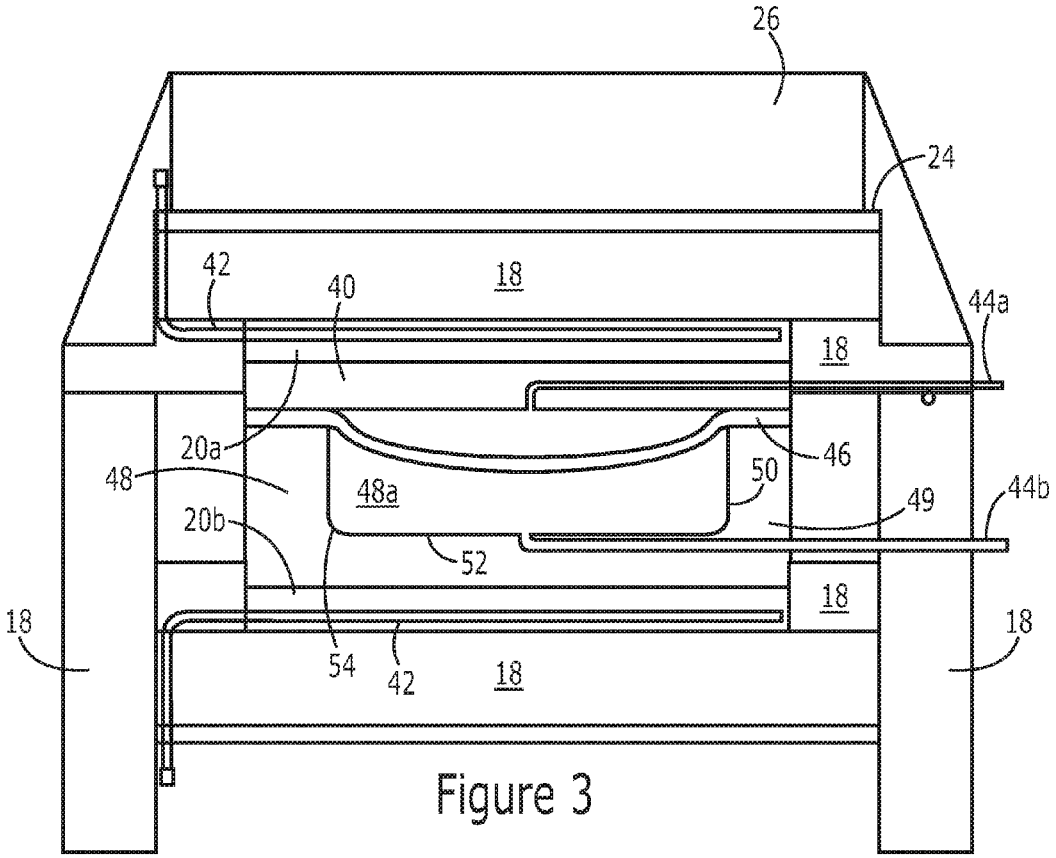
Figure 4:
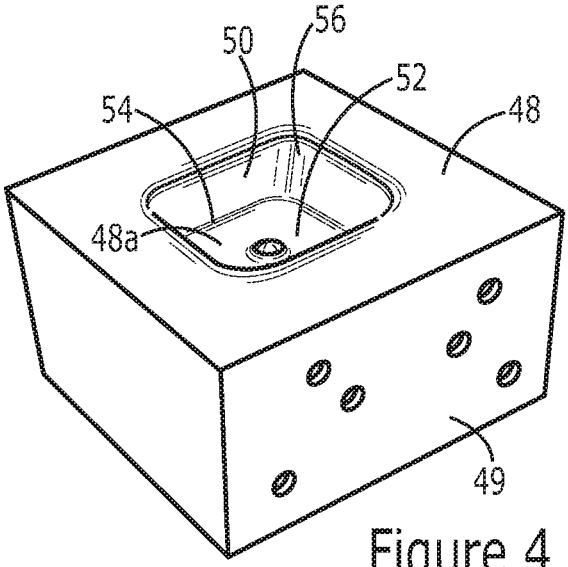
Figure 5:
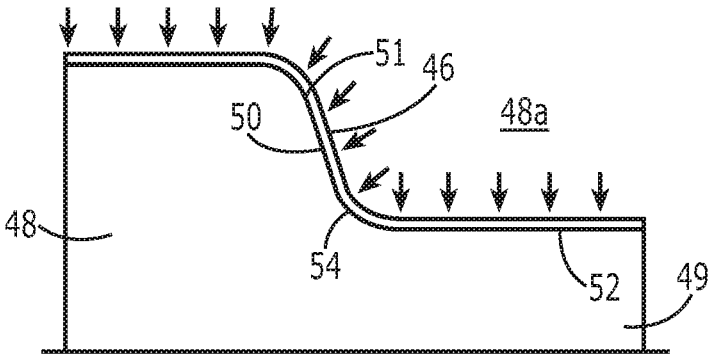
Figure 6:
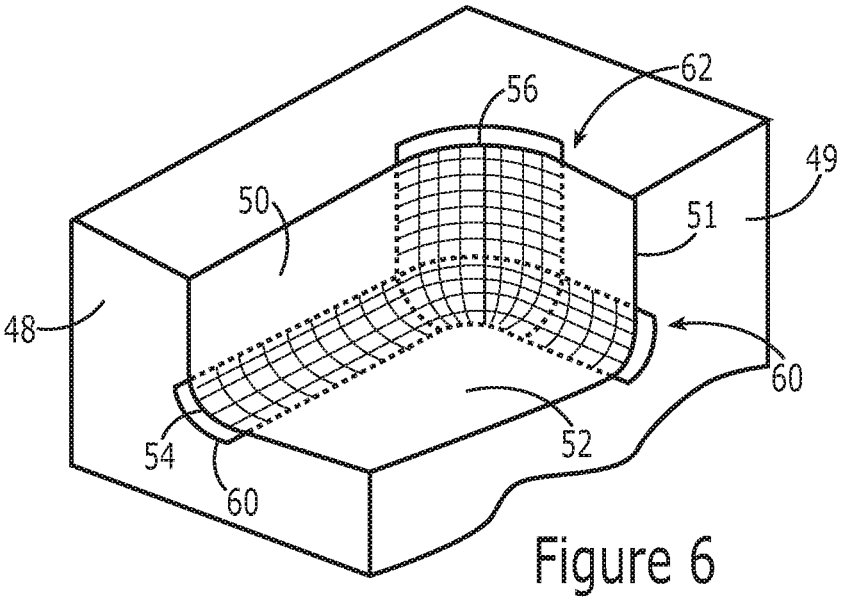
Figure 7:
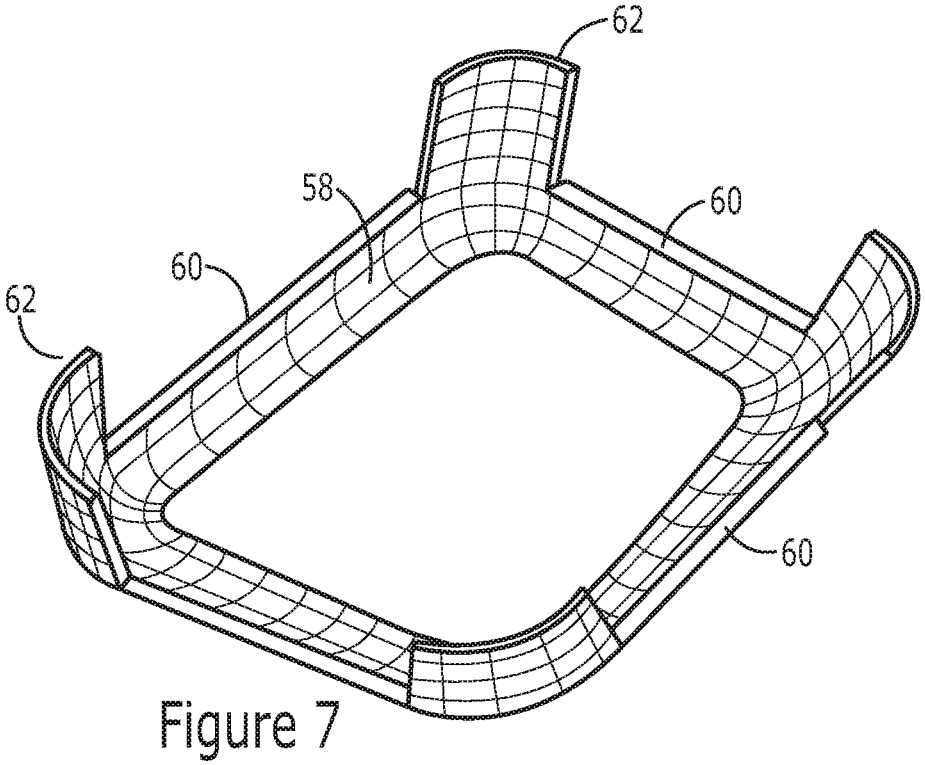
Figure 8:
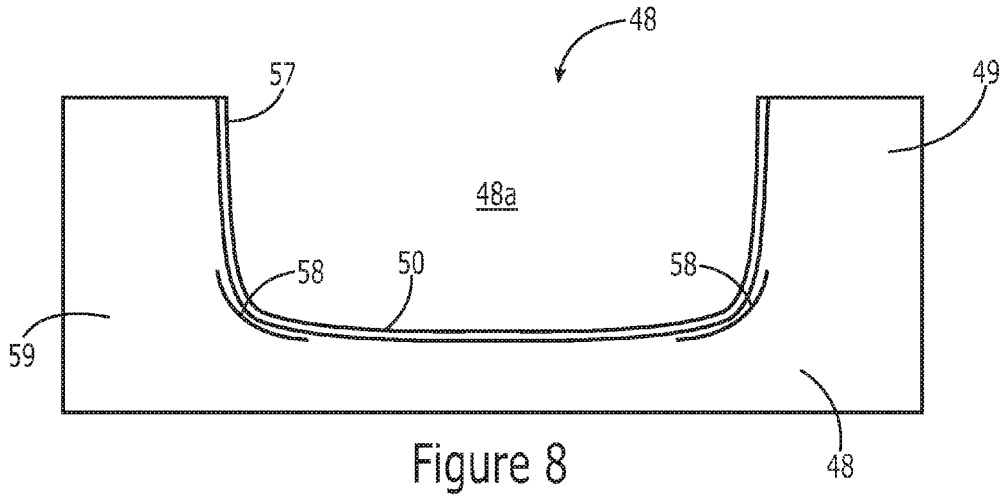
Figure 9:
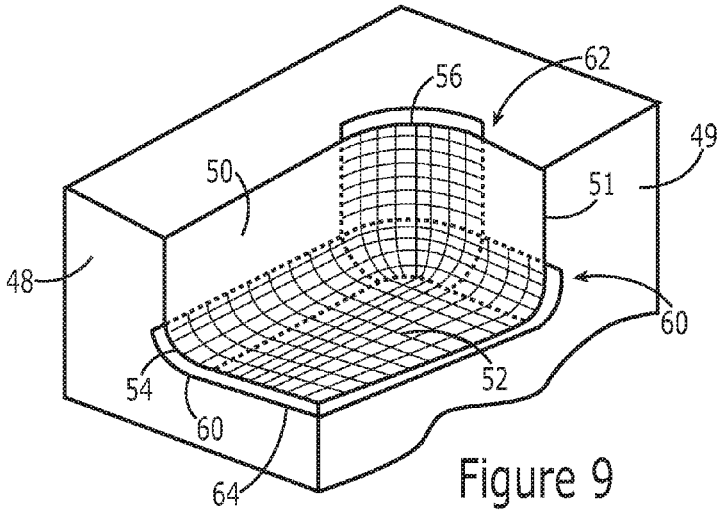
Figure 10:
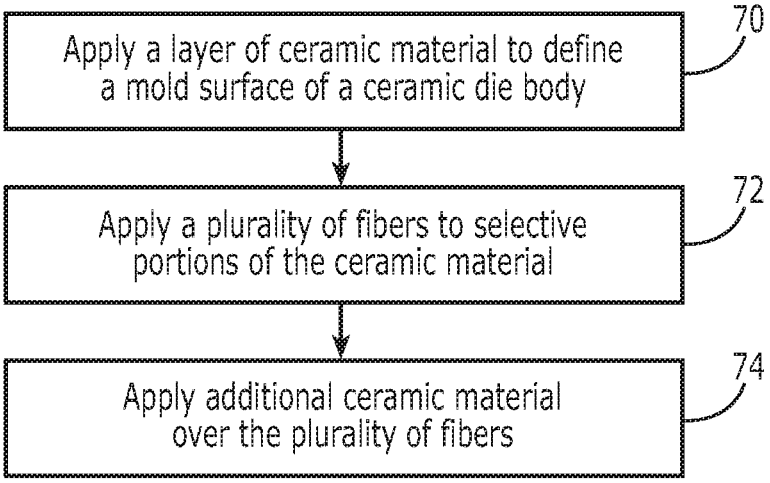

Having thus described aspects of the present disclosure in general terms, reference will now be made to the accompanying drawings, which are not necessarily drawn to scale, and wherein:

FIG. 1 is a perspective view of a hot press, such as a hot forming press or a superplastic forming press, in accordance with an example embodiment of the present disclosure;

FIG. 2 is a perspective view of the hot press of FIG. 1 in which the heat shield has been removed for purposes of illustration in accordance with an example embodiment of the present disclosure;

FIG. 3 is a cross sectional view of a portion of a hot press including a ceramic die in accordance with an example embodiment of the present disclosure;

FIG. 4 is a perspective view of a ceramic die in accordance with an example embodiment of the present disclosure;

FIG. 5 is a schematic representation of a portion of a ceramic die illustrating the forces to which the ceramic die is subjected during superplastic forming operations;

FIG. 6 is a perspective view of a portion of a ceramic die that includes a plurality of fibers configured to selectively reinforce the ceramic die in accordance with an example embodiment of the present disclosure;

FIG. 7 is a perspective view of a weave of fibers that is utilized to selectively reinforce a ceramic die in accordance with an example embodiment of the present disclosure;

FIG. 8 is a cross-sectional view of the ceramic die of FIG. 6;

FIG. 9 is a perspective view of a portion of another ceramic die that includes a plurality of fibers configured to selectively reinforce both the curved surfaces and the floor of the ceramic die in accordance with an example embodiment of the present disclosure; and FIG. 10 is a flow chart illustrating operations performed during the construction of a ceramic die in accordance with an example embodiment of the present disclosure.

DETAILED DESCRIPTION

The present disclosure now will be described more fully hereinafter with reference to the accompanying drawings, in which some, but not all aspects are shown. Indeed, the disclosure may be embodied in many different forms and should not be construed as limited to the aspects set forth herein. Rather, these aspects are provided so that this disclosure will satisfy applicable legal requirements. Like numbers refer to like elements throughout.

A ceramic die for a hot press is provided, along with a method of constructing a ceramic die. The ceramic die is selectively reinforced in a manner that reduces the likelihood of cracking and the likelihood of flaking of the mold surface. Thus, the ceramic die of an example embodiment has a longer lifetime in order to reduce the overall costs associated with superplastic forming operations. In this regard, a hot press employing the ceramic die needs to be taken off line less frequently in order to replace a ceramic die that has failed, thereby reducing the financial cost and down time associated with replacing a ceramic die that has failed during superplastic forming operations.

A ceramic die is utilized to form a part, such as an aircraft part or a part for another application, within a hot press. As shown in FIG. 1, one example of a hot press 10, such as a hot forming press or a superplastic forming press, is depicted. The hot press includes a press frame 12. In order to provide insulation to an internal cavity defined by the press frame in which the part is formed, the hot press may include a heat shield 13 mounted to the press frame. Although the heat shield may be constructed in various manners, the heat shield of an example embodiment may include a frame 14 formed of a corrosion-resistant steel (CRES) alloy and sheet metal 16 covering the frame. Within the frame, the heat shield may include one or more ceramic refractory insulation blocks 18 facing the internal cavity within which the part is formed. The ceramic refractory insulation blocks serve to insulate the hot press and to maintain the temperature within the internal cavity during hot forming or superplastic forming operations which are conducted at elevated temperatures, such as 700° F. to 1700° F.

As shown in FIG. 2, the hot press 10 of FIG. 1 is depicted with the heat shield having been removed for purposes of illustration. The hot press defines an internal cavity within which the dies for forming the part may be disposed. The dies are supported by platens, such as an upper platen **20*a* and a lower platen 20*b*. The platens may be fabricated from, for example, CRES alloys. In order to provide insulation for the platens and the forming dies, the hot press may also include one or more ceramic refractory insulation blocks 18** that, in combination with a respective platen, comprise a hot press platen assembly. Thus, an upper hot press platen assembly may include the upper platen and one or more ceramic refractory insulation blocks that surround the upper platen. Similarly, a lower hot press platen assembly may include the lower platen and one or more ceramic refractory insulation blocks that surround the lower platen. The ceramic refractory insulation blocks that comprise a hot press platen assembly are positioned adjacent to and partially surround the respective platen. In this regard, the ceramic refractory insulation blocks of a hot press platen assembly may be positioned about the edge portions of a respective platen so as to insulate the platen. The ceramic refractory insulation blocks of a hot press assembly may also be positioned across the rear surface of the respective platen, that is, the surface of the respective platen opposite the internal cavity in which the part is formed.

As shown in FIGS. 1 and 2, the hot press 10 of the illustrated embodiment may also include a cooling plate 24 and a bolster plate 26 to support and cool the upper platen 20*a*. Further, the hot press may include one or more alignment guides 28 that maintain the platens and, in turn, the forming dies carried by the platens in alignment within the press frame 12 as the platens are moved relative to one another. With respect to the hot press of FIGS. 1 and 2, the upper platen 20*a* may be raised and lowered relative to the lower platen 20*b*. In the illustrated embodiment, the hot press includes a first hydraulic cylinder 30 configured to apply a pressing force urging the first and second platens toward one another and a second, smaller hydraulic cylinder 32 configured to raise and lower the upper platen. The hot press of the illustrated embodiment may also include a die cushion assembly 34.

Referring now to FIG. 3, a cross-sectional view of a portion of a hot press 10 in the form of a superplastic forming press is shown. In the illustrated embodiment, upper and lower platens 20*a*, 20*b* support a lid 40 and a die 48, which serves to define and form the part. The lid 40 may be formed of various materials including steel, such as CRES. The die 48 includes die body 49 which, in turn, defines a die cavity 48*a* in which a workpiece 46 is formed into a part having a shape as defined by the die cavity. In the illustrated embodiment, a portion of the workpiece 46, such as edges of the workpiece, are engaged between the lid 40 and the die 48 and is held in place therebetween. Thereafter, the workpiece 46 is subjected to an elevated temperature and a pressure differential is applied to opposite sides of the workpiece in order to superplastically deform the workpiece into a shape defined by the die cavity 48*a*. As shown in FIG. 3, the upper and lower platens 20*a*, 20*b* may be heated which, in turn, heats the lid 40 and the die 48 and the workpiece 46 positioned therebetween. While the upper and lower platens 20*a*, 20*b* may be heated in various manners, the upper and lower platens of an example embodiment may include electric heater rods 42 disposed within lengthwise extending passageways defined by the respective platens. As to the pressure differential, the hot press 10 of the illustrated embodiment includes a gas line 44*a* that extends through the lid 40 and injects a gas that forces the workpiece 46 into the die cavity 48*a*. In this embodiment, another gas line 44*b* also extends through the die 48 in order to permit gas to be vented from the die cavity 48*a* as the workpiece 46 is subjected to a superplastic forming operation.

As shown in FIG. 4, the ceramic die body 49 defines a mold surface 50 that is configured to shape the part during the superplastic forming process. The mold surface 50 may have various shapes depending upon the desired shape of the part. However, in the example of FIG. 4, the mold surface 50 of the ceramic die body 49 defines a pan-like shape having upstanding walls 51 and a floor 52. The upstanding walls 51 are joined to the floor 52 by a rounded corner 54 and the upstanding walls are similarly joined to one another by rounded corners 56. Regardless of the precise shape of the part to be formed and, in turn, the shape of the mold surface 50, the mold surface defines at least one curved surface and at least one non-curved surface, spaced apart from the at least one curved surface. In the example of FIG. 4, the rounded corners 54, 56 between the upstanding walls 51 and the floor 52 are curved surfaces, while the upstanding walls and the floor themselves are non-curved surfaces.

During a superplastic forming operation, pressure is exerted on the workpiece 46 as a result of a pressure differential between opposite sides of the workpiece. The pressure differential is created by the injection of gas through the inlet 44*a* which forces the workpiece 46 into the die cavity 48*a* defined by the ceramic die 48 and into contact with the mold surface 50, thereby causing the part to assume the shape defined by the mold surface. As shown in FIG. 5, as the workpiece 46 is forced against the mold surface 50, a force is created perpendicular to the die face, that is, perpendicular to the mold surface. This force causes the curved surfaces of the mold surface 50, such as the rounded corners 54, 56 of the mold surface, to be in tension, thereby causing the curved surfaces, such as the rounded corners, to be subjected to relatively high tensile stresses, while the non-curved surfaces experience much lower tensile stresses. Thus, the curved surfaces, such as the rounded corners, of a conventional ceramic die may be much more likely to crack and fail than the non-curved surfaces of the mold surface of a conventional ceramic die.

In order to increase the longevity of a ceramic die and to permit the ceramic die to withstand more cycles of a superplastic forming operation, the ceramic die 48 of an example embodiment is selectively reinforced with a plurality of fibers 58. As shown in FIG. 6, the ceramic die body 49 of an example embodiment includes a plurality of fibers 58 that are preferentially located proximate regions of the ceramic die body that are more likely to fail in the absence of the fibers than other regions of the ceramic die. Thus, the regions of the ceramic die body 49 that are otherwise more likely to fail are configured to include a plurality of fibers 58, while other regions of the ceramic die body that are less likely to fail may be independent of the fibers, wherein independent of fibers means being free of the fibers, or may include a substantially lower percentage of the fibers. In the embodiment depicted in FIG. 6, for example, the plurality of fibers 58 are preferentially located proximate the curved surfaces of the mold surface 50 with the non-curved surfaces of the mold surface being, in one example embodiment, independent of the plurality of fibers or at least include a much smaller percentage of the fibers.

Although the fibers 58 may be provided in various manners, the fibers of an example embodiment are provided as a weave or a tape of fibers. In this regard, a weave or cloth of fibers 58 defines a multidimensional, such as a two dimensional, weave of fibers, such as a satin weave, a square weave or a tricot weave, while a tape of fibers defines a plurality of generally parallel fibers bound, for example, in a matrix material or other type of epoxy. During the fabrication of the ceramic die 48 as described below, the weave or tape of fibers 58 may preferentially located proximate the curved surfaces of the ceramic die body 49 as shown in FIG. 6. For example, the ceramic die 48 of the illustrated embodiment includes a weave 60 of fibers 58 about the rounded corner 54 between the upstanding walls 51 and the floor 52. In addition, the ceramic die 48 of the illustrated embodiment includes a weave 62 of fibers 58 about the rounded corners 56 between the upstanding walls 51. Thus, the weave or tape of the fibers 58 may extend radially about the curved surface, but may terminate prior to extending across a non-curved surface of the mold surface 50. Thus, the non-curved surfaces of the mold surface 50 may be independent of the weave or tape of fibers 58. By way of example and for purposes of illustration, FIG. 7 illustrates the weave of fibers 58 placed within the ceramic die body 49 of FIG. 6 proximate the curved surfaces of the mold surface 50. As shown, the weave of fibers 58 extend radially about the curved surfaces of the mold surface 50, but do not extend across the non-curved surfaces of the mold surface such that the non-curved surfaces of the mold surface are independent of the weave of optical fibers.

Although the plurality of fibers 58 may be oriented in various directions, the plurality of fibers of an example embodiment are oriented such that the fibers extend radially about a curved surfaces of the mold surface 50. In this regard, a weave 60, 62 of fibers 58 is positioned such that the fibers that extend in one direction through the weave are oriented so as to extend radially about the curved surfaces of the mold surface 50. Similarly, a tape of fibers is oriented such that the fibers extend radially about the curved surfaces of the mold surface 50.

As a result of the placement of the fibers 58 proximate the curved surfaces of the mold surface 50 that are subjected to greater tensile stresses during the superplastic formation of a part, the rounded corners 54, 56 of the ceramic die 48 are selectively reinforced and therefore the likelihood of the rounded corners failing is reduced. In this regard, the fibers 58 reinforce the ceramic material and permit the rounded corners 54, 56 to withstand, on average, the elevated tensile stresses for a greater number of cycles of the superplastic forming process.

As also shown in FIG. 6, the plurality of fibers 58 are preferentially located in accordance with an example embodiment proximate the mold surface 50. Thus, the plurality of fibers 58 of this example embodiment are located adjacent to or very near to the mold surface 50, such as within a distance measured in terms of a predefined multiple, such as 1, 2, . . . 5, of the diameter of the fibers of the mold surface. In an example embodiment, the plurality of fibers 58 are disposed within one quarter of an inch an inch of the mold surface 50. As described below in conjunction with the construction of the ceramic die 48, the plurality of fibers 58 may be preferentially located either at or very near the mold surface 50 such that a first portion of the ceramic die body 49 proximate the mold surface has a greater percentage of fibers than a second portion of the ceramic die body spaced apart from the mold surface. Indeed, the second portion of the ceramic die body 49 spaced apart from the mold surface 50 may, in one embodiment, be independent of the plurality of fibers. In the embodiment described above in which the plurality of fibers 58 are in the form of a weave or tape of fibers, the weave or tape of fibers may be selectively positioned proximate the mold surface 50, while the remainder of the ceramic die body 49 further remote from the mold surface is independent of the weave or tape of fibers. With reference to FIG. 8, the first portion of the ceramic die body 49 proximate the mold surface 50 may be defined by a combination of an initial layer 57 of ceramic material and the plurality of fibers 58, e.g., the weave or tape of fibers, so as to have a greater percentage of fibers than the remainder of the ceramic die material that forms the second portion, e.g., the exterior portion 59, of the ceramic die body that is spaced apart from the mold surface by the plurality of fibers, e.g., the weave or tape of fibers. In this regard, the ceramic material itself may include some percentage of fibers, albeit a much lower percentage than that provided by the weave or tape of fibers, or the ceramic material may be free of fibers, other than the weave or tape of fibers, in which case the percentage of fibers within the second portion of the ceramic die body 49 is 0%. By preferentially locating the fibers 58 proximate the mold surface 50, the ceramic die 48 of this example embodiment provides increased resistance to flaking during superplastic forming operations, thereby reducing spalling and improving the performance and longevity of the ceramic die.

The plurality of fibers 58 may only be located proximate the mold surface 50 in the vicinity of the curved surfaces as shown in FIGS. 6-8. In other embodiments, however, the plurality of fibers 58 may be located proximate the mold surface 50 not only in the vicinity of the curved surfaces, but also proximate at least some of the non-curved surfaces, such as the non-curved surfaces that are considered most likely to otherwise flake during superplastic forming operations. As shown in FIG. 9, for example, the ceramic die 48 also includes a plurality of fibers 64 proximate the floor 52 of the ceramic die body 49.

The ceramic die 48 of an example embodiment may include a variety of different types of fibers 58. In an example embodiment, however, the plurality of fibers 58 are ceramic fibers that are configured to withstand the elevated temperatures and tensile stresses to which the ceramic die 48 will be subjected during superplastic forming operations, such as ceramic fibers that will not change phase and will not change volume when subjected to the elevated temperatures and pressures experienced during the superplastic forming operations. In this regard, examples of the ceramic fibers 58 that may be preferentially located within a ceramic die 48 of an example embodiment include both oxide and non-oxide ceramic fibers. By way of example, the oxide fibers include alumina fibers, such as Nextel™ 312 fibers, Nextel™ 440 fibers, Nextel™ 480 fibers, Nextel™ 550 fibers, or Nextel™ 610 fibers provided by 3M, Saffil fibers composed of 96 wt % $Al_2O_3$ and 4 wt % $SiO_2$, Saphikon fibers composed of single crystal $Al_2O_3$, Sumitomo fibers composed of 85 wt % $Al_2O_3$ and 15 wt % $SiO_2$ and Almax fibers composed of more than 99.5 wt % $Al_2O_3$. Other examples of oxide fibers include yttria fibers, zirconia fibers, yttria stabilized zirconia fibers as well as $MgAl_2O_4$, $Na_2O_3$ and YAG silica-based glass fibers. Further, examples of non-oxide fibers include fibers formed of B, C, SiC, $Si_3N_4$, BN and $B_4C$ including, for example, Nicalon (NL202) fibers, Hi-Nicalon fibers, coated Nicalon fibers HPZ fibers, β-SiC fibers and SCS-6 fibers.

The ceramic die 48 of an example embodiment may be formed in various manners. In one embodiment, however, a form is provided that defines the mold surface 50 of the ceramic die body 49. As shown in block 70 of FIG. 10, an initial layer 57, such as a relatively thin layer, of ceramic material may then be applied to the surface of the form. Although various ceramic materials may be utilized, the ceramic material may be a castable fused silica, such as Ceradyne 220 provided by Ceradyne, Inc., in an example embodiment. The thickness of this initial layer of ceramic material that is applied to the form may vary. However, the method of an example embodiment forms the thickness of this initial layer to be no more than and, in one embodiment, approximately equal to the diameter of the fibers 58 that will be preferentially located thereupon. In one embodiment, for example, the initial layer of ceramic material has a thickness of no more than one quarter of an inch.

As shown in block 72, a plurality of fibers 58, such as a weave or tape of fibers, is preferentially applied to the initial layer of ceramic material. In this regard, the weave or tape of fibers is preferentially applied so as to extend about the curved surfaces of the mold surface 50, such as radially about the rounded corners 54, 56 of the mold surface. However, the plurality of fibers 58 of an example embodiment are selectively applied in such a manner so as to not extend across the non-curved surfaces of the mold surface 50 such that the non-curved surfaces of the mold surface are independent of the plurality of fibers. Following the preferential application of the plurality of fibers 58, additional ceramic material is applied so as to overlie the plurality of fibers, as shown in block 74 of FIG. 10. This additional ceramic material generally forms the exterior portion 59 of the ceramic die body 49, which, in turn, forms a much greater extent of the ceramic die body than the initial layer 57 of ceramic material such that the plurality of fibers 58 are also preferentially located proximate the mold surface 50. As a result, the portions of the ceramic die body 49 more remote from the mold surface 50, such as those portions of the ceramic die body formed by the additional ceramic material applied over the plurality of fibers 58 are also independent of the plurality of fibers.

Once cured, the ceramic die 48 may be removed from the form and then utilized in superplastic forming operations. As a result of the selective reinforcement provided by the preferential location of the plurality of fibers 58 proximate those regions of the mold surface 50 that are subjected to greater tensile stress and/or are more likely to flake, the resulting ceramic die 48 has a lower likelihood of cracking or flaking and has increased fatigue and other mechanical properties. Thus, the ceramic die 48 of an example embodiment can withstand a greater number of superplastic forming operations, on average, prior to failure.

Many modifications and other aspects of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A ceramic die comprising:

a ceramic die body defining a mold surface configured to shape a part during a superplastic forming process, wherein the mold surface defines at least one curved surface and at least one non-curved surface, spaced apart from the at least one curved surface; and a plurality of fibers disposed within the ceramic die body, wherein the plurality of fibers are located proximate the at least one curved surface such that a first portion of the ceramic die body proximate the at least one curved surface has a greater percentage of fibers than a second portion of the ceramic die body proximate the at least one non-curved surface.

2. A ceramic die according to claim 1 wherein the plurality of fibers comprise a weave or tape of fibers located proximate the at least one curved surface.

3. A ceramic die according to claim 2 wherein the ceramic die body proximate the at least one non-curved surface is independent of the weave or tape of fibers.

4. A ceramic die according to claim 1 wherein the plurality of fibers extend about the at least one curved surface and terminate prior to extending across the at least one non-curved surface.

5. A ceramic die according to claim 1 wherein the plurality of fibers comprise ceramic fibers.

6. A ceramic die according to claim 1 wherein the plurality of fibers are also located proximate the mold surface such that a portion of the ceramic die body proximate the mold surface has a greater percentage of fibers than a portion of the ceramic die body spaced apart from the mold surface.

7. A ceramic die comprising:

a ceramic die body defining a mold surface configured to shape a part during a superplastic forming process; and a plurality of fibers disposed within the ceramic die body, wherein the plurality of fibers are located proximate the mold surface such that a first portion of the ceramic die body proximate the mold surface has a greater percentage of fibers than a second portion of the ceramic die body spaced apart from the mold surface.

8. A ceramic die according to claim 7 wherein the plurality of fibers comprise a weave or tape of fibers located proximate the mold surface.

9. A ceramic die according to claim 8 wherein the second portion of the ceramic die body spaced apart from the surface is independent of the weave or tape of fibers.

10. A ceramic die according to claim 7 wherein the plurality of fibers comprise ceramic fibers.

11. A ceramic die according to claim 7 wherein the mold surface defines at least one curved surface and at least one non-curved surface, spaced apart from the at least one curved surface, and wherein the plurality of fibers are also located proximate the at least one curved surface such that a portion of the ceramic die body proximate the at least one curved surface has a greater percentage of fibers than another portion of the ceramic die body proximate the at least one non-curved surface.

12. A ceramic die according to claim 11 wherein the plurality of fibers extend about the at least one curved surface and terminate prior to extending across the at least one non-curved surface.

13. A method of constructing a ceramic die, the method comprising:

applying a layer of ceramic material to define a mold surface of a ceramic die body;

applying a plurality of fibers to at least portions of the layer of ceramic material; and applying additional ceramic material over the plurality of fibers, wherein the additional ceramic material forms a greater extent of the ceramic die body than the layer of ceramic material such that the fibers are located proximate the mold surface since that a first portion of the ceramic die body proximate the mold surface has a greater percentage of fibers than a second portion of the ceramic die body spaced apart from the mold surface.

14. A method of constructing a ceramic die according to claim 13 wherein applying the plurality of fibers comprises applying a weave or tape of fibers to at least portions of the layer of ceramic material.

15. A method of constructing a ceramic die according to claim 14 wherein the second portion of the ceramic die body spaced apart from the surface is independent of the weave or tape of fibers.

16. A method of constructing a ceramic die according to claim 13 wherein the plurality of fibers comprise ceramic fibers.

17. A method of constructing a ceramic die according to claim 13 wherein the mold surface defines at least one curved surface and at least one non-curved surface, spaced apart from the at least one curved surface, and wherein applying the plurality of fibers comprises applying the plurality of fibers so as to also be located proximate the at least one curved surface such that a portion of the ceramic die body proximate the at least one curved surface has a greater percentage of fibers than another portion of the ceramic die body proximate the at least one non-curved surface.

18. A method of constructing a ceramic die according to claim 17 wherein applying the plurality of fibers comprises extending the plurality of fibers about the at least one curved surface so as to terminate prior to extending across the at least one non-curved surface.

19. A method of constructing a ceramic die according to claim 17 wherein applying the plurality of fibers comprises applying the plurality of fibers such that the ceramic die body proximate the at least one non-curved surface is independent of the weave or tape of fibers.

* * * * *